United States Patent [19]

Schumacher

[11] 4,378,966

[45] Apr. 5, 1983

[54] APPARATUS FOR CONTROLLING A PIPE-CUTTING DEVICE

[75] Inventor: Wilhelm Schumacher, Dusslingen, Fed. Rep. of Germany

[73] Assignee: Fa. Christian Majer K.G., Maschinenfabrik, Tuebingen, Fed. Rep. of Germany

[21] Appl. No.: 110,929

[22] Filed: Jan. 10, 1980

Related U.S. Application Data

[63] Continuation-in-part of Ser. No. 911,303, Jun. 1, 1978, abandoned.

[30] Foreign Application Priority Data

Jun. 2, 1977 [DE] Fed. Rep. of Germany ..... 2724899

[51] Int. Cl.[3] ..... B31C 3/00

[52] U.S. Cl. ..... 493/22; 493/35; 493/290; 493/301; 83/76

[58] Field of Search ..... 493/22, 35, 28, 8, 289, 493/290, 288, 301, 299; 83/76

[56] References Cited

U.S. PATENT DOCUMENTS

| | | | |
|---|---|---|---|
| 3,133,483 | 5/1964 | Glasby | 493/290 |
| 3,668,957 | 6/1972 | Nido | 83/76 X |
| 4,091,315 | 5/1978 | Hayashi et al. | 83/76 X |
| 4,170,155 | 10/1979 | Saito et al. | 83/76 |
| 4,220,077 | 9/1980 | Miller et al. | 493/299 X |

*Primary Examiner*—James F. Coan

[57] ABSTRACT

A process and arrangement for controlling a pipe-cutting device for cutting pipe formed on a continuously operating spiral winding machine which forms a pipe from a band of wound sheet material such as paper. The pipe-cutting device is adapted to move along the formed pipe at a speed corresponding to the feeding speed of the band which is being guidingly fed at a predetermined feed angle toward the pipe-forming spindle of the spiral winding machine. An arrangement is provided in a continuous spiral pipe-winding machine for controlling the movement of a cutting member. The cutting member is mounted on a sled adapted to reciprocate along the spindle of the pipe-winding machine at an advancing speed which is continuously adjusted in accordance with the advancing speed of the pipe and is of a construction for carrying out the process of this invention, whereby the band of sheet material which is fed to the winding spindle of the machine is guided over a measuring roller which is operatively connected to a pulse emitter. The pulse emitter is operatively connected with a pulse counter of an AND/OR-comparator stage, the outpulses of which release the advance of the cutting member.

2 Claims, 3 Drawing Figures

APPARATUS FOR CONTROLLING A PIPE-CUTTING DEVICE

CROSS-REFERENCE TO RELATED APPLICATION

This is a continuation-in-part application of our copending application Ser. No. 911,303, filed on June 1, 1978 and now abandoned.

BACKGROUND OF THE INVENTION

The invention relates to a process for controlling a pipe-cutting arrangement in a continuously operating pipe-forming machine for forming wound pipes made of bands of sheet material. The invention also pertains to an arrangement for carrying out the afore-described process. Continuously operating pipe-winding arrangements are already known in the art. In particular, spiral winding machines are known which include a sled reciprocally mounted along the wound pipe which carries a cutting member. The velocity of the axial displacment of the sled equals the advancing speed of the pipe during the cutting process. Such known arrangement furthermore includes feeler means which sense the position of the end of the pipe and thereby terminate the cutting process (see for example German published patent application No. 2 612 795). This known arrangement includes a pipe velocity measuring circuit for avoiding a permissible marking of the lengthwise measurement on the pipe. This pipe velocity measuring circut includes a plurality of photocells and a variable time-delay member which effects a delay of the starting signal coming from the feeler for the cutting arrangement in dependence from the scanned pipe velocity.

SUMMARY OF THE INVENTION

It is a general object of this invention to obtain a simple process and correspondingly simpler arrangement for controlling the pipe-cutting arrangement.

The object of this invention is attained by means of a process whereby the pipe-cutting arrangement is controlled in dependence with the cut length of the band of sheet material that is run into the pipe winding machine. Thus the length of the continuously prepared pipe strand which is to be cut into pipe sections is determined by measuring the length of the band of sheet material that is being run into the winding machine.

The process of the invention can be carried out by an arrangement for controlling the movement of a cutting member, whereby the advancing speed of the wound pipe is matched by a reciprocating sled carrying a cutting member, the velocity of which corresponds to the advancing speed of the pipe during the cutting process. The arrangement includes a measuring roller over which the band of sheet material is guided and which runs to a winding spindle of a pipe winding machine. The measuring roller is coupled to an electric pulse emitter which in turn is connected with an AND-OR counter of an AND/OR-comparator stage, the outpulse of which releases the advance of the cutting member. The AND/OR counter of an AND/OR value-comparator stage can with its OR value input be connected with a computer which takes into consideration the pipe diameter, the width of the band of sheet material, and the running-in angle of the winding spindle. Furthermore, the AND/OR-comparator stage includes an adjusting member for arbitrary adjustment of the OR-pulse number.

The process in accordance with the invention has the advantage that no measuring arrangement is necessary in the region of the wound pipe. Such measuring arrangements frequently cause malfunctions and resultant downtime for the entire machine. The measuring arrangement on the running-in side of the band of sheet material, for example, a paper band, does not constitute an obstacle and possible cause for malfunction of the machine. Such a measuring arrangement is very compact; the measuring roller of the arrangement is coupled to a pulse emitter of the type of conventional number of revolution counters. The length of the band of sheet material is determined in accordance with the running-in angle of the band, the width of the band and the diameter of the wound pipe. These values can be tabularly maintained in accordance with the adjustment of the OR-value in the AND/OR value-comparator stage or by means of a control arrangement connected to a computer which automatically determines these values. If deviations in length occur, they are corrected by corresponding arbitrary adjustment of the pulse number–OR-value.

BRIEF DESCRIPTION OF THE DRAWING

In order that the invention may be more readily understood, reference is made to the accompanying drawings which illustrate diagrammatically and by way of example two embodiments thereof, and in which.

DETAILED DESCRIPTION

Figure 1:
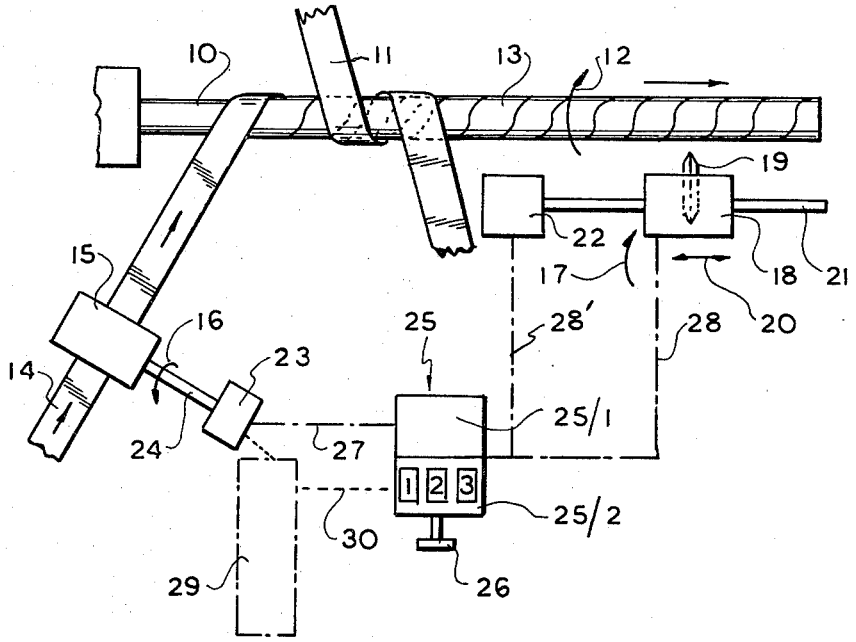
FIG. 1 is a schematic illustration of a spiral winding machine having a pipe-cutting mechanism and an appurtenant control arrangement for the pipe-cutting mechanism.

FIG. 1 is a very schematic illustration of the arrangement of the invention. There is illustrated a winding spindle 10 of a spiral winding machine onto which the pipe to be formed is wound in a known manner by means of a winding belt 11 so that it is driven in the direction of the arrow 12. There is guided towards the winding spindle 10 for purposes of forming a spirally wound pipe 13 a band of sheet material 14, for example, a paper band, obliquely to the longitudinal axis of the winding spindle 10. The conventional guide rollers and glue supply roller for the band 14 have not been illustrated for sake of simplicity. There is furthermore included in the arrangement a measuring roller 15 over which the band 14 is guided and which is rotated in the direction of the arrow 16.

The pipe-cutting arrangement 17 of the pipe winding machine includes a sled 18 which has a cutting knife which is perpendicularly adjustably mounted relative to the longitudinal direction of the spirally wound pipe 13 and which can be reciprocally moved in the direction of the double arrow 20 along a guide shaft 21 or any other conventional guide support means. The drive 22 for the pipe cutting arrangement 17 and cutting knife 19 is symbolically illustrated by means of a box 22. The drive 22 is synchronized in a conventional manner and ensures that at the moment of the release of the cutting knife 19 the sled 18 moves synchronously with the spiral wound pipe 13.

The adjusting arrangement comprises, in the embodiment of FIG. 1, a pulse emitter 23 which is coupled to the shaft 24 of the rotating measuring roller 15, which rotates in the direction of the arrow 16. The pulse emitter 23 emits counting pulses in dependence with the rotation of the measuring roller 15 and these pulses are conducted to an AND/OR-comparator stage 25. The pulses are then counted in the AND portion 25/1 and are compared with the predetermined OR pulse number of the OR pulse portion 25/2. The AND/OR value-comparator stage 25 is adjustable by means of an adjusting knob 26 for arbitrary adjustment of the put in OR value-pulse number. The electrical connection between the pulse emitter 23 and the AND value portion 25/1 of the AND value/OR value-comparator stage 25 is represented by a thick-dotted line 27. The output of the AND/OR value-comparator stage 25 is connected via another conduit, also illustrated by a thick-dotted line 28 to the release mechanism for the cutting knife on the sled 18. By means of an electrical connection represented by the dash-dotted line 28' the operations of the comparator stage 25 and the drive 22 for the sled 18 are coordinated. Thereby the return movement of the sled 18 into a new starting cutting position in dependence with the comparator stage 25 can be carried out, that is after a cutting operation has been released and has been terminated. As soon as the AND value-pulse number reaches the output in OR value-pulse number, the drive 22 for the pipe-cutting arrangement 17 is actuated via the conduit 28 by means of an outpulse of the AND/OR value-comparator stage 25, whereby the cutting knife 19 cuts the pipe 13 while the sled 18 is synchronously moved with the wound pipe 13. The OR value-pulse number can also automatically be determined by a computer 29 which has been illustrated by means of thin-dotted lines and which is connected with the OR-value portion 25/2 of the AND/OR value-comparator stage 25 via an electrical conduit 30 which is indicated by a dotted line. A non-illustrated tachometer may be used to synchronize the speed of the winding spindle 13 to the speed of the drive 22.

Figure 2:
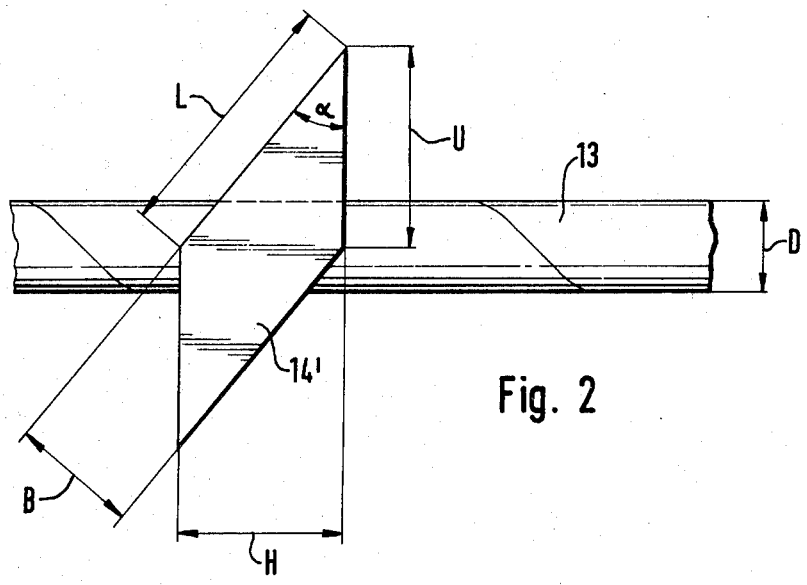
FIG. 2 is a section of a spirally wound pipe with a section of the band of sheet material forming the spirally wound pipe in which the magnitudes which control the relationship between the band of sheet material and the length of wound pipe are set forth.

FIG. 2 illustrates a portion of the spiral by wound pipe 13 and a section 14' of the band of sheet material from which the spirally wound pipe is formed. All magnitudes which are controlling and determinative of the band length for spirally wound pipe lengths are set forth in FIG. 2. Thus it can be noted that B = the width of the band of sheet material 14, $\alpha$ = the running-in angle of the band of sheet material 14, D = the diameter of the pipe to be formed 13, U = the circumference of the pipe 13, L = the length of the formed spiral path, H = the axial advancing distance per pipe rotation.

The following relationship holds true for such a winding arrangement:

$$U/B = L/H$$

This relationship must be taken in consideration by the computer 29.

Figure 3:
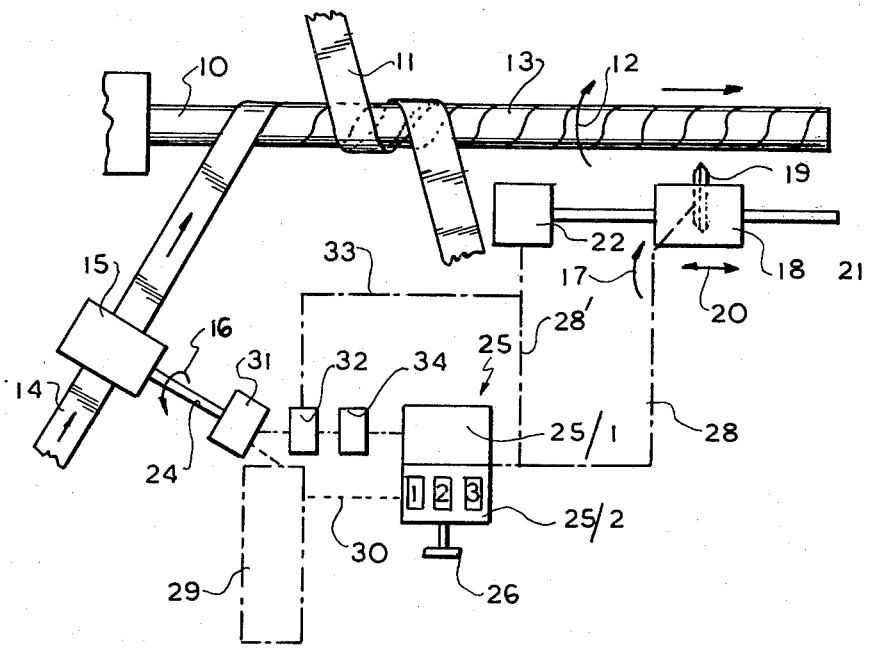
FIG. 3 is a schematic illustration according to FIG. 1, wherein a second embodiment of the control arrangement for the pipe-cutting mechanism is illustrated.

FIG. 3 illustrates a second embodiment of a control arrangement. In lieu of the pulse emitter 23 the control arrangement includes a tacho-generator 31 which emits an analog signal in dependence with the number of revolutions of the measuring roller 15. The analog signal 31 is transmitted to a potentiometer circuit 32. In this potentiometer circuit the angle $\alpha$, more precisely the sin $\alpha$ is used. The output signal of the tachogenerator only renders a value for the feed speed of the band 14. The potentiometer circuit 32 is effective in controlling the synchronous running of the drive arrangement 22 via the electrical connection indicated by 33. The analog output signal of the potentiometer circuit 32 is transmitted via an analog-digital-converter 34 onto the AND/OR value-comparator stage, the arrangement and operation of which has been described in connection with the embodiment of FIG. 1.

Although the invention is illustrated and described with reference to a plurality of preferred embodiments thereof, it is to be expressly understood that it is in no way limited by the disclosure of such embodiments, but is capable of numerous modifications within the scope of the appended claims.

What is claimed is:

1. In a continuous spiral pipe winding machine having a winding spindle for winding a band of sheet material and a cutting member operatively mounted on a sled which is movable reciprocally along said winding spindle which cutting member advances along said winding spindle during operation at the same speed as the advancing movement of the formed pipe, an arrangement for controlling the advancing speed of said cutting member toward said winding spindle in dependence with the feed speed of said band of sheet material, comprising in combination, a guide roller rotatably mounted in said machine over which said band of sheet material is guided;

a pulse emitter operatively connected to said guide roller;

drive means mounted in said machine for reciprocally moving said cutting member toward said spindle;

and AND/OR-value-comparator stage having a pulse counter and an AND/OR-comparator, said pulse emitter being operatively connected to said pulse counter;

and said AND/OR-comparator being operatively connected to said drive means, the outpulses of said comparator being conducted to said drive means thereby determining the speed of movement of said cutting member toward said spindle; said AND-/OR-value-comparator stage has an OR-value input stage, and computer means being operatively connected to said pulse emitter, on the one hand, and said OR-value input stage, on the other hand; said computer receiving and processing pulse sequences which are being emitted in accordance with the width B of the band and the running-in angle $\alpha$ of the band with respect to the spindle.

2. In a continuous spiral pipe winding machine having a winding spindle for winding a band of sheet material and a cutting member reciprocally movably mounted along said winding spindle, the arrangement as set forth in claim 1, wherein said AND/OR-value comparator stage includes adjusting means for arbitrarily adjusting the OR-value pulse number of said comparator.

* * * * *